US010412491B2

(12) United States Patent
Zou

(10) Patent No.: US 10,412,491 B2
(45) Date of Patent: Sep. 10, 2019

(54) BAND-PASS ACOUSTIC FILTER AND ACOUSTIC SENSING APPARATUS

(71) Applicant: GOERTEK, INC., Weifang, Shandong (CN)

(72) Inventor: Quanbo Zou, Weifang (CN)

(73) Assignee: GOERTEK, INC., Weifang, Shandong (CN)

( * ) Notice: Subject to any disclaimer, the term of this patent is extended or adjusted under 35 U.S.C. 154(b) by 0 days.

(21) Appl. No.: 15/562,410

(22) PCT Filed: Oct. 30, 2015

(86) PCT No.: PCT/CN2015/093453
§ 371 (c)(1),
(2) Date: Sep. 27, 2017

(87) PCT Pub. No.: WO2017/070950
PCT Pub. Date: May 4, 2017

(65) Prior Publication Data

US 2018/0288526 A1 Oct. 4, 2018

(51) Int. Cl.

| | |
|---|---|
| ***H04R 3/04*** | (2006.01) |
| ***H04R 19/00*** | (2006.01) |
| ***H04R 19/04*** | (2006.01) |
| ***H04R 29/00*** | (2006.01) |
| ***H04R 1/22*** | (2006.01) |
| ***H04R 3/00*** | (2006.01) |

(52) U.S. Cl.
CPC ..... *H04R 3/04* (2013.01); *H04R 19/005* (2013.01); *H04R 19/04* (2013.01); *H04R 29/005* (2013.01); *H04R 1/227* (2013.01); *H04R 3/005* (2013.01); *H04R 2201/003* (2013.01)

(58) Field of Classification Search
CPC ..... H04R 3/04; H04R 19/005; H04R 19/04; H04R 29/005; H04R 2201/003; H04R 3/005; H04R 1/227
See application file for complete search history.

(56) References Cited

U.S. PATENT DOCUMENTS

| | | | | |
|---|---|---|---|---|
| 7,933,428 | B2 * | 4/2011 | Sawada | H04R 1/406 257/416 |
| 2008/0240482 | A1 * | 10/2008 | Haddad | H04R 1/2807 381/337 |
| 2012/0250897 | A1 * | 10/2012 | Michel | H04R 1/406 381/111 |

(Continued)

FOREIGN PATENT DOCUMENTS

| | | | |
|---|---|---|---|
| CN | 102595294 | A | 7/2012 |
| CN | 102595295 | A | 7/2012 |
| CN | 202587369 | U | 12/2012 |

OTHER PUBLICATIONS

Shen et al., Design Considerations for an acoustic MEMS filter, 2004, Microsystem Technologies, 585-591 (Year: 2004).*

*Primary Examiner* — Sonia L Gay
(74) *Attorney, Agent, or Firm* — Hultquist, PLLC; Steven J. Hultquist

(57) ABSTRACT

The present invention discloses a band-pass acoustic filter and an acoustic sensing apparatus. The band-pass acoustic filter including at least two MEMS microphone chips and an ASIC chip, wherein the output signals of the MEMS microphone chips are processed in the ASIC chip after being coupled.

8 Claims, 2 Drawing Sheets

(56) References Cited

U.S. PATENT DOCUMENTS

| | | | | |
|---|---|---|---|---|
| 2014/0270247 | A1* | 9/2014 | Swanson | H04R 3/005 381/92 |
| 2015/0146885 | A1* | 5/2015 | Fitzgerald | H04R 3/005 381/98 |
| 2017/0048623 | A1* | 2/2017 | Qutub | H04R 19/005 |
| 2017/0245059 | A1* | 8/2017 | Durand | H04R 19/005 |

* cited by examiner

BAND-PASS ACOUSTIC FILTER AND ACOUSTIC SENSING APPARATUS

CROSS-REFERENCE TO RELATED APPLICATION

This application is a U.S. national phase under the provisions of 35 U.S.C. § 371 of International Patent Application No. PCT/CN2015/093453 filed Oct. 30, 2015. The disclosure of such international patent application is hereby incorporated herein by reference in its entirety, for all purposes.

FIELD OF THE INVENTION

The present invention relates to MEMS microphone technology, and in particular, to band-pass acoustic filter and an acoustic sensing apparatus.

BACKGROUND OF THE INVENTION

In the prior art, a MEMS (Microelectromechanical Systems) microphone is a microphone manufactured based on the MEMS technique. Generally, a MEMS microphone includes a MEMS microphone chip and an integrated circuit (ASIC), for converting received sound wave into sound electrical signal.

Typically, a MEMS microphone chip has a resonance frequency at its high frequency side. The resonance frequency can depend on the Helmholtz resonator formed by the front chamber (or back chamber/cavity), the resonance frequency of the diaphragm and so on.

Generally, the MEMS microphone chip has a narrow bandwidth of the resonance frequency. Furthermore, the resonance frequency is uncertainty due to manufacturing tolerance. Therefore, in the prior art, the MEMS microphone is not used to directly detect sound of a certain frequency.

In the prior art, a filter is provided in the ASIC to filter the sound electric signal. However, the SNR of the MEMS microphone chip will be degraded because it needs extra electronic components. In addition, these extra electronic components will cause extra product complexity. For example, on-chip capacitor and on-chip resistor will be needed.

SUMMARY OF THE INVENTION

One object of this invention is to provide a new technical solution for band-pass acoustic filter.

According to an embodiment of the present invention, there is provided a band-pass acoustic filter, including: at least two MEMS microphone chips; and an ASIC chip, wherein the output signals of the MEMS microphone chips are processed in the ASIC chip after being coupled.

Preferably, each of the MEMS microphone chips is mounted above the acoustic port of a substrate.

Preferably, the band-pass acoustic filter further includes a metal case, for forming a back cavity for the MEMS microphone chips, wherein the MEMS microphone chips are acoustically coupled through the back cavity.

Preferably, the band-pass acoustic filter further includes a substrate, wherein the metal case and the substrate form an enclosed back cavity together.

Preferably, the output signals are coupled in series.

Preferably, the resonance frequency of each of the MEMS microphone chips is adjusted by setting at least one of diaphragm resonance frequency, front-chamber size and acoustic port dimension of the MEMS microphone chip.

According to another embodiment of the present invention, there is provided an acoustic sensing apparatus, comprising the band-pass acoustic filter according to the present invention, for sensing sound wave.

Preferably, the sound wave include ultrasonic wave.

Preferably, the acoustic sensing apparatus is a microphone.

In addition, it should be understood by a person skilled in the art that, although a lot of problems exist in the prior art, the solution of each embodiment or each claim could just improve in one or several aspects, and it is not necessary for it to solve all the technical problems listed in the Background of the Invention or in the prior art. It should be understood by a person skilled in the art that content which is not mentioned in a claim should not be regarded as a limitation to said claim.

Further features of the present invention and advantages thereof will become apparent from the following detailed description of exemplary embodiments according to the present invention with reference to the attached drawings.

BRIEF DESCRIPTION OF THE DRAWINGS

The accompanying drawings, which are incorporated in and constitute a part of the specification, illustrate embodiments of the invention and, together with the description thereof, serve to explain the principles of the invention.

DETAILED DESCRIPTION OF THE EMBODIMENTS

Figure 1:
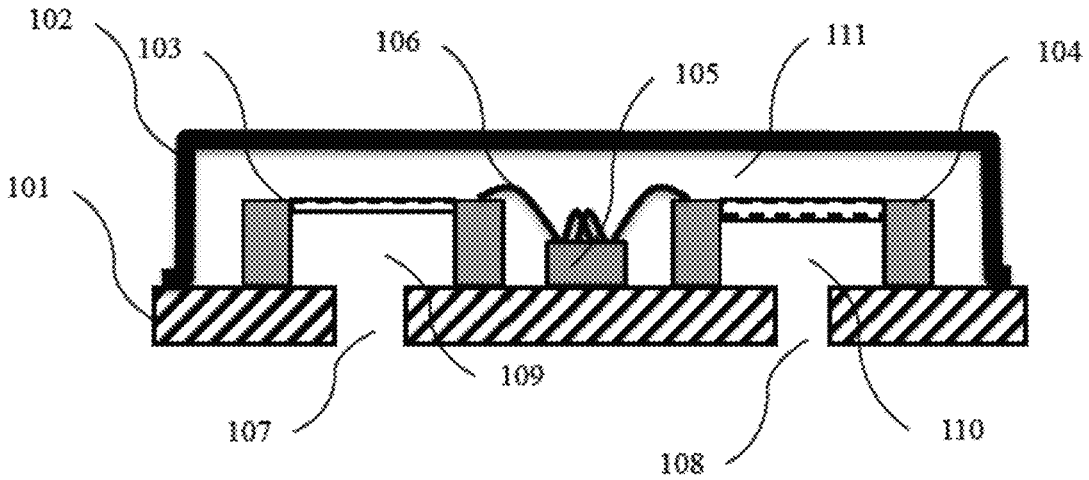
FIG. 1 shows an illustrative diagram of a band-pass acoustic filter according to an embodiment of the present invention.

Various exemplary embodiments of the present invention will now be described in detail with reference to the drawings. It should be noted that the relative arrangement of the components and steps, the numerical expressions, and numerical values set forth in these embodiments do not limit the scope of the present invention unless it is specifically stated otherwise.

The following description of at least one exemplary embodiment is merely illustrative in nature and is in no way intended to limit the invention, its application, or uses.

Techniques, methods and apparatus as known by one of ordinary skill in the relevant art may not be discussed in detail but are intended to be part of the specification where appropriate.

In all of the examples illustrated and discussed herein, any specific values should be interpreted to be illustrative only and non-limiting. Thus, other examples of the exemplary embodiments could have different values.

Notice that similar reference numerals and letters refer to similar items in the following figures, and thus once an item is defined in one figure, it is possible that it need not be further discussed for following figures.

Embodiments and examples of the present invention will be described below with reference to the drawings.

FIG. 1 shows an illustrative diagram of a band-pass acoustic filter according to an embodiment of the present invention.

As shown in FIG. 1, the band-pass acoustic filter includes two MEMS microphone chips 103, 104 and an ASIC chip 105. It should be understood by a person skilled in the art that the number of the MEMS microphone chips is not limited to two but can be more than two.

The output signals of the MEMS microphone chips 103, 104 are coupled to the ASIC chip 105 via leads 106. The output signals can first be coupled via the leads 106 and then be input into the ASIC chip 105, or they can be coupled in the ASIC chip. It shall be understood be a person skilled in the art, the ASIC chip can be separate from the MEMS microphone chips, or can be built in the MEMS microphone chips. The coupled output signals are processed in the ASIC chip. For example, the processed signals are output to other electronic device, such as other components of mobile phone, positioning device and so on.

In an example, the output signals are coupled in series, to improve the SNR of the band-pass acoustic filter.

The resonance bandwidth of the microphone chip can be increased by coupling the output of the two MEMS microphone chips. For example, in FIG. 2, the dash line 202 indicates output curve of a first microphone chip, and the dash line 203 indicates output curve of a second microphone chip. The solid line 201 indicates the combination of the two output curves. A band-pass is formed at the top of the solid line 201.

Figure 3:
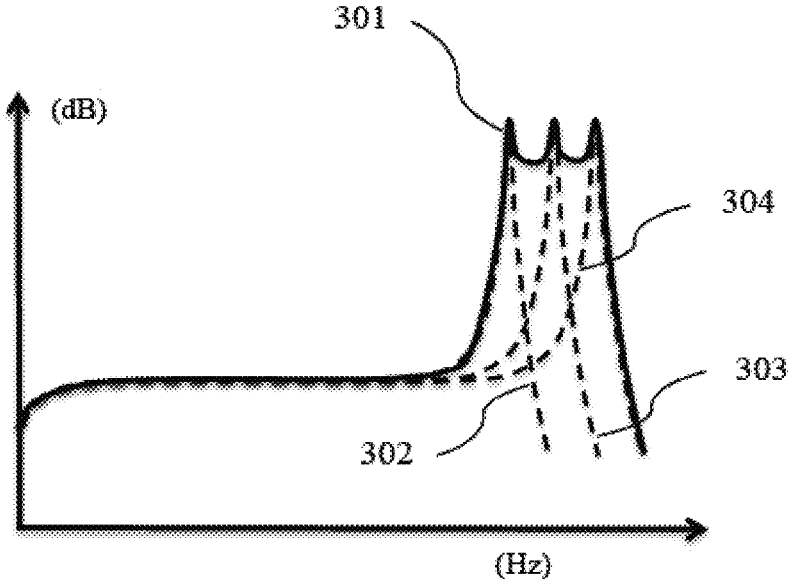
FIG. 3 shows an illustrative graph for explaining the effect of a band-pass acoustic filter according to another embodiment of the present invention.

A graph combining three MEMS microphone chips is shown as an example in FIG. 3. The dash line 302 indicates output curve of a first microphone chip, the dash line 303 indicates output curve of a second microphone chip, and the dash line 304 indicates output curve of a third microphone chip. The solid line 301 indicates the combination of the three output curves. A broader band-pass is formed at the top of the solid line 301.

Figure 2:
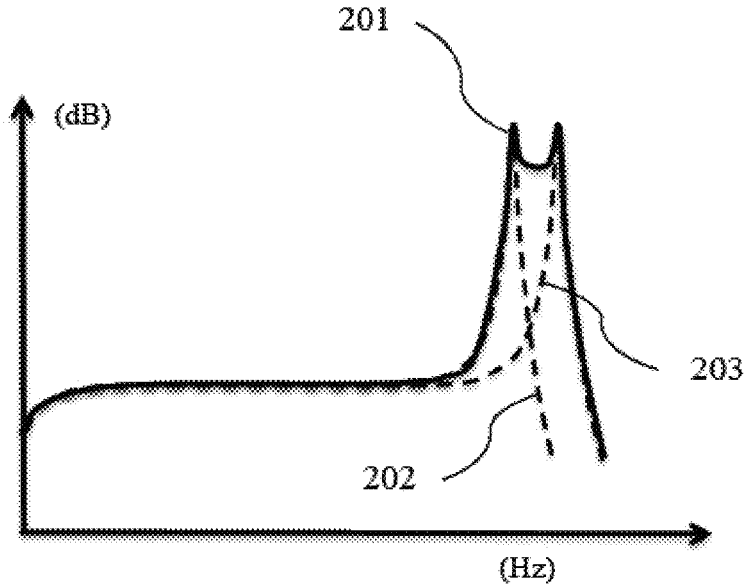
FIG. 2 shows an illustrative graph for explaining the effect of a band-pass acoustic filter according to an embodiment of the present invention.

In FIG. 2 and FIG. 3, the abscissa indicates frequency and the ordinate indicates sensitivity. The graphs in FIGS. 2 and 3 are just illustrative and do not indicate actual graph shapes, and an actual value cannot be identified from the curves.

On one hand, the band-pass can be used to filter sound wave input. On the other hand, since this band-pass acoustic filter have a relatively good characteristic at a relatively high frequency, a microphone formed by using this band-pass acoustic filter can have a relatively good sound characteristic at high frequency components.

Alternatively, as shown in FIG. 1, each of the MEMS microphone chips 103, 104 is mounted above a substrate 101 such as a PCT board. The opening of the MEMS microphone chip corresponds to the acoustic port 107, 108 of the substrate 101.

Alternatively, in FIG. 1, the band-pass filter further includes a metal case 102, for forming a back cavity 111 for the MEMS microphone chips. The MEMS microphone chips 103, 104 are acoustically coupled through the back cavity 111. For example, the metal case 102 and the substrate 101 form an enclosed back cavity 111 together.

By means of this acoustic coupling, the sensitivity and/or SNR of the band-pass acoustic filter can be further improved.

For example, the resonance frequency of each of the MEMS microphone chips is adjusted by setting at least one of diaphragm resonance frequency, front-chamber size and acoustic port dimension of the MEMS microphone chip.

Figure 4:
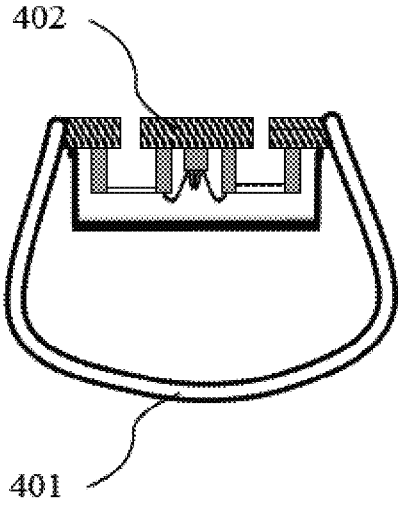
FIG. 4 shows an illustrative diagram of an acoustic sensing apparatus according to an embodiment of the present invention.

FIG. 4 shows an illustrative diagram of an acoustic sensing apparatus 401 according to an embodiment of the present invention. The acoustic sensing apparatus 401 comprises the band-pass acoustic filter 402 according to the present invention, for sensing sound wave. The band-pass acoustic filter 402 is that as shown in FIG. 1, for example.

In an example, the acoustic sensing apparatus can be used to sense ultrasonic wave. For example, an object can be positioned by sensing ultrasonic wave.

In another example, this acoustic sensing apparatus can be used a microphone. Since the band-pass acoustic filter of this invention can improve the high frequency components of a MEMS microphone chips, this kind of microphone will have a relatively good high frequency characteristics.

Although some specific embodiments of the present invention have been demonstrated in detail with examples, it should be understood by a person skilled in the art that the above examples are only intended to be illustrative but not to limit the scope of the present invention. It should be understood by a person skilled in the art that the above embodiments can be modified without departing from the scope and spirit of the present invention. The scope of the present invention is defined by the attached claims.

What is claimed is:

1. A band-pass acoustic filter, including:

at least two Microelectromechanical Systems, MEMS, microphone chips, which have different resonance bandwidths; and an Application-Specific Integrated Circuit, ASIC, chip, wherein the output signals of the MEMS microphone chips are coupled to form and increase one resonance band pass of the band-pass acoustic filter by combining the different resonance bandwidths of the MEMS microphone chips and then are processed in the ASIC chip, wherein the band-pass acoustic filter further includes a metal case, for forming a back cavity for the MEMS microphone chips, wherein the MEMS microphone chips are acoustically coupled through the back cavity.

2. The band-pass acoustic filter according to claim 1, wherein each of the MEMS microphone chips is mounted above the acoustic port of a substrate.

3. The band-pass acoustic filter according to claim 1, further including a substrate, wherein the metal case and the substrate form an enclosed back cavity together.

4. The band-pass acoustic filter according to claim 1, wherein the output signals are coupled in series.

5. The band-pass acoustic filter according to claim 1, wherein the resonance frequency of each of the MEMS microphone chips is adjusted by setting at least one of diaphragm resonance frequency, front-chamber size and acoustic port dimension of the MEMS microphone chip.

6. An acoustic sensing apparatus, comprising the band-pass acoustic filter according to claim 1, for sensing a sound wave.

7. The acoustic sensing apparatus according to claim 6, wherein the sound wave includes ultrasonic wave.

8. The acoustic sensing apparatus according to claim 6, wherein the acoustic sensing apparatus is a microphone.

* * * * *